United States Patent [19]

Vandiver

[11] Patent Number: 4,905,718

[45] Date of Patent: Mar. 6, 1990

[54] TENT STAKE

[76] Inventor: Joe E. Vandiver, 920 S. National - Apt. 5, Springfield, Mo. 65804

[21] Appl. No.: 362,931

[22] Filed: Jun. 8, 1989

[51] Int. Cl.[4] ..... E04H 15/62

[52] U.S. Cl. ..... 135/118

[58] Field of Search ..... 135/118, 902; 248/156; 24/711.4

[56] References Cited

U.S. PATENT DOCUMENTS 4,077,418 3/1978 Cohen ..... 135/118 X 4,432,382 2/1984 Wolf ..... 135/118

FOREIGN PATENT DOCUMENTS 665845 of 1964 Italy ..... 248/156

*Primary Examiner*—Carl D. Friedman

*Assistant Examiner*—Lan Mai

*Attorney, Agent, or Firm*—Richard C. Litman

[57] ABSTRACT

A tent stake and a method to manufacture the tent stake. The tent stake is essentially comprised of two parts which are mechanically pressed one onto the other. The mechanical pressing process eliminates the need for any welding of the two parts to hold them together. The tent stake is simply an elongated rod with an enlarged eyelet at the top through which a guy wire or a rope may be threaded. The eyelet at the top is fashioned to accept a person's finger so that he may easily remove the stake from the solid substrate in which it is fixed. The eyelet is large enough to hold a loop or grommet which may be positioned below it to hold an object in place. The stake may alternately be provided with a series of removable barbs at or near its point to help hold the stake fixed in the ground or other pertinent substrate.

1 Claim, 1 Drawing Sheet

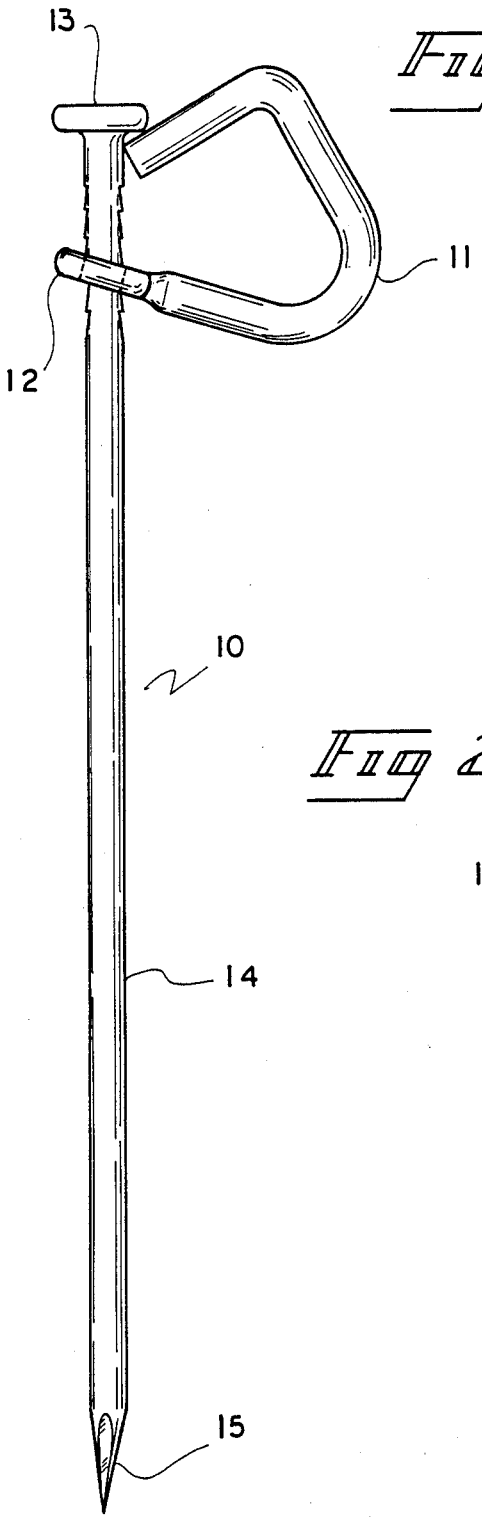
Fig 1
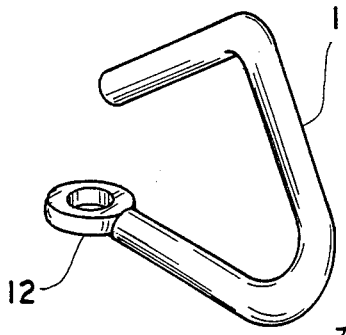
Fig 3
Fig 2
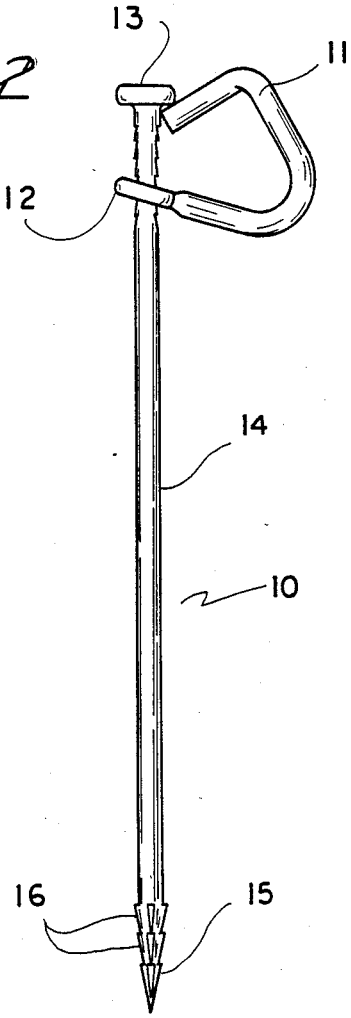

TENT STAKE

BACKGROUND OF THE INVENTION

1. Field of the invention

The present invention relates to the development of stakes used to secure objects to the ground. More specifically, the present invention relates to the development of stakes used to erect tents and the like by securing a guy wire or rope thereto. The present invention focuses upon a design that can be used in a variety of ground hardnesses including rock.

2. Description of the prior art

There have been a number of stakes invented in the past to solve a variety of problems. However, among them, there are few that provide a simple, effective means for tying down an object as well as providing a cheap and effective method of manufacture.

The present invention provides a simple construction for a tent stake as well as a simple means for manufacture. Previous tent stakes such as that described by U.S. Pat. No. 2,156,021 issued to J. A. Little on April 25, 1939 have disclosed a variety of designs. However, this stake, though unique, requires considerable effort to install. No stake disclosed may be used for securing a tent both to a rock surface and to other less hard surfaces.

The present invention provides a simplified approach to the standard tent stake. The stake is designed to facilitate both insertion of the stake into a material such as soil as well as facilitate the removal of the stake from the material. The head and shank of the stake is designed to provide the user with a sturdy gripping area. In fact, the eyelet itself is designed to accept a finger from the user to this end.

The head of the shank of the stake is designed to provide a broad surface area. This facilitates the installation of the stake in the appropriate substrate. As mentioned, the stake is designed such that it may be driven into both soft and hard materials. The most common use of the tent stake of the present invention is the use of the stake as a means to secure a tent to the ground. However, there are many alternate uses of the stake which will become obvious as this discussion unfolds.

SUMMARY OF THE INVENTION

Therefore, it is an object of the present invention to provide a stake that can secure a guy wire loop, grommet, or rope to a variety of ground hardnesses including near solid rock or ice.

It is another object of the present invention to provide a stake that has an enlarged eyelet at its top portion. This will reduce the frustration of the person who uses the present invention, because he will not have difficulty when threading the stake. Additionally, the enlarged eyelet aids in the removal of the stake from the material in which it is secured. The enlarged eyelet serves as a finger hold and also doubles as a hook for loops.

It is another object of the present invention to provide a large head area atop the stake in order to facilitate the securing of the stake in a substrate material.

It is yet another object of the present invention to provide a stake that has a simple construction. This feature will provide for easy and inexpensive manufacture.

It is yet another object of the present invention to provide a shank to the stake of sufficient strength and length to prevent inadvertent removal of the stake once positioned.

It is still another object of the present invention to provide barbs at the lowermost region of the shank to prevent the inadvertent removal of the stake from the surface in which it is embedded.

It is yet another object of the present invention that the shank should be of such a size to pass easily through grommets or loops before becoming embedded into the solid substrate.

It is another object of the present invention to provide a method of manufacture for the tent stake of the present invention.

It is still another object of the present invention to provide a method of manufacture that does not require the welding of parts together. The present invention accomplishes the task of a immovable connection of parts by pressing the individual components together thereby creating a mechanical advantage between those parts so deformed.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

FIG. 1 is a side elevation of the present invention showing the pertinent features.

FIG. 2 is a side elevation of an alternate embodiment of the present invention. The barbs near the end of the shank are the pertinent features in this illustration.

FIG. 3 is a perspective illustration of the eyelet bracket separated from the tent stake shank.

Similar reference characters designate corrsponding parts throughout the various figures of the drawings.

DESCRIPTION OF THE PREFERRED EMBODIMENT

The present invention is designated 10 in FIG. 1. The stake 10 has a shank 14 which is a straight, rigid member. At the top most region of the shank 14, there is a head 13. The head 13 is a flattened disk mounted and attached perpendicular to the axis of the shank 14. Preferably, the head 13 has a diameter that is at least twice that of the shank 14 diameter. The head 13 provides an area of sufficient size that one may strike it with a hammer and drive the stake 10 into the ground. As such, the head 13 need not be at least twice the diameter of the shank 14, but such a size is both desired and recommended. At the opposite end of the stake 10 is a point 15. The point 15 has a substantially conical shape.

Although the stake 10 may be used primarily to hold an object such as a tent to the ground, the stake 10 mat serve any number of alternate applications. It is envisioned that the present invention may be used to provide a means to hang tools and the like to a wall. The stake 10 may also be used for mountain climbing to secure a climber's rope to a rock face, however, the stake 10 would need to pass whatever safety guidelines apply to accouterments for such use. The safety of the present invention in certain applications such as mountain climbing is not affirmed here. Such will be left for future determination. The applicability of the stake 10 is virtually limitless and is not restricted to the short list provided above.

Also at the top most region, an eyelet 11 is located. This eyelet 11 is a substantially rectangular segment that defines a space through which a guy wire or rope may be threaded. Additionally, the eyelet 11 is designed to accept a finger so that the stake 10 may be easily removed from the solid substrate in which it is embedded. The eyelet 11 is of a substantial size as to allow a loop or grommet to be hooked below it. The eyelet 11 is welded to an eyelet bracket 12 which surrounds the shank 14 a small distance from the head 13. The eyelet bracket 12 may be welded to the shank 14 so that it remains fixed relative to the head 13. In an alternate embodiment, the shank 14 may be pinched below the eyelet bracket 12 to keep the eyelet bracket 12 held firmly in place.

However, the preferred method for making the stake 10 is much simpler and requires less material and effort. The eyelet bracket 12 is essentially a circular disk with a bore in its center. If the eyelet 11 begins as a straight bar of material, its shape can be formed while on or off the shank 14. To accomplish the formation of the eyelet 11 while on the shank 14, the eyelet 11 and attached eyelet bracket 12 are slipped over the shank 14. The eyelet 11 is formed by bending the material into a substantially rectangular shape. The eyelet 11 represents three sides of that square. The shank 14, eyelet 11 bar, eyelet bracket 12 can be press fitted during the bending process such that the pieces are fixedly attached to one another. Thus, the mechanical deformation of each respective piece will serve to attach the two primary components to one another. The end result is the utilization of the mechanical advantage between the parts pressed onto one another during the bending of the eyelet bar 11. This process does not require welding, and as such, requires less time and effort during the process of manufacture.

In an alternate embodiment of the present invention, the tip 15 of the stake 10 may be provided with barbs 16. These barbs 16 may take any shape, though small triangular barbs 16 are preferred. It may also be preferred that the barbs 16 be removable so that the stake 10 may suit any theoretical application. The small triangular barbs 16 will provide sufficient strength to hold the stake 10 in place without hindering the removal of the stake 10 from the ground.

It is preferred that the composition of the tent stake 10 be uniform throughout the various parts and components. In fact, the preferred material is steel or any derivative alloy. Steel provides the appropriate tensile and compressive strength to be an ideal choice for the construction of the present invention. The mechanical advantage attained by bending the eyelet bar 11 such that the eyelet bracket 12 is pressed into the shank 14 is best accomplished through the use of steel. However, so as not to limit the unlimited practicality of the present invention, it should by no means be understood that the present invention is limited in any way to any particular material. It is possible that in applications requiring a less strong securing means, the tent stake 10 may be composed of materials such as plastic or other suitable material.

It is to be understood that the present invention is not limited to the sole embodiment described above, but encompasses any and all embodiments within the scope of the following claims.

I claim:

1. A tent stake comprising:

a shank comprising a substantially elongated member having two ends, a top end and a bottom end, a head located at said top end of said shank and attached to said top end perpendicular to the axis formed by said shank, a point substantially in the shape of a cone or the like located at and attached to said bottom end of said shank, an eyelet bar being mechanically deformed to fabricate an eyelet, an eyelet being defined by said eyelet bar having three sides substantially in the shape of a rectangle and having two ends, a fixed end and a free end, the fourth side of said eyelet being formed by a segment of said shank, said fixed end of said eyelet bar being attached to an eyelet bracket, said free end of said eyelet bar located next to but not attached to said shank at said top end, and said eyelet bracket substantially in the shape of a toroid surrounding and attached to said shank.

* * * * *